US008603943B2

(12) United States Patent
Stork et al.

(10) Patent No.: US 8,603,943 B2
(45) Date of Patent: Dec. 10, 2013

(54) THERMOSENSITIVE RECORDING MATERIAL

(75) Inventors: Gerhard Stork, Flensburg (DE); Annette Schreiber, Kosel (DE); Diana Valentina Becerra Siabato, Flensburg (DE)

(73) Assignee: Mitsubishi HiTec Paper Europe GmbH, Flensburg (DE)

( * ) Notice: Subject to any disclaimer, the term of this patent is extended or adjusted under 35 U.S.C. 154(b) by 457 days.

(21) Appl. No.: 12/621,553

(22) Filed: Nov. 19, 2009

(65) Prior Publication Data

US 2011/0028317 A1 Feb. 3, 2011

(30) Foreign Application Priority Data

Jul. 28, 2009 (EP) ..... 09166559

(51) Int. Cl.
*B41M 5/333* (2006.01)
*B41M 5/44* (2006.01)

(52) U.S. Cl.
USPC ..... 503/216; 503/200; 503/208; 503/214; 503/217; 503/221; 503/226

(58) Field of Classification Search
USPC ..... 503/200–226
See application file for complete search history.

(56) References Cited

U.S. PATENT DOCUMENTS 6,800,588 B2 * 10/2004 Iwasaki et al. ..... 503/226

* cited by examiner

*Primary Examiner* — Bruce H Hess
(74) *Attorney, Agent, or Firm* — Cozen O'Connor

(57) ABSTRACT

A proposed heat-sensitive recording material comprises a substrate, a heat-sensitive recording layer containing color formers and color acceptors, and a protective layer covering this heat-sensitive recording layer. The heat-sensitive recording layer has, as color acceptor, at least 66⅔ percent by weight of 4,4'-dihydroxydiphenyl sulfone based on the total percentage of color acceptors in the heat-sensitive recording layer, and the protective layer has, as binder, at least 60 percent by weight of diacetone-modified polyvinyl alcohol based on the total percentage of binder in the protective layer.

13 Claims, 1 Drawing Sheet

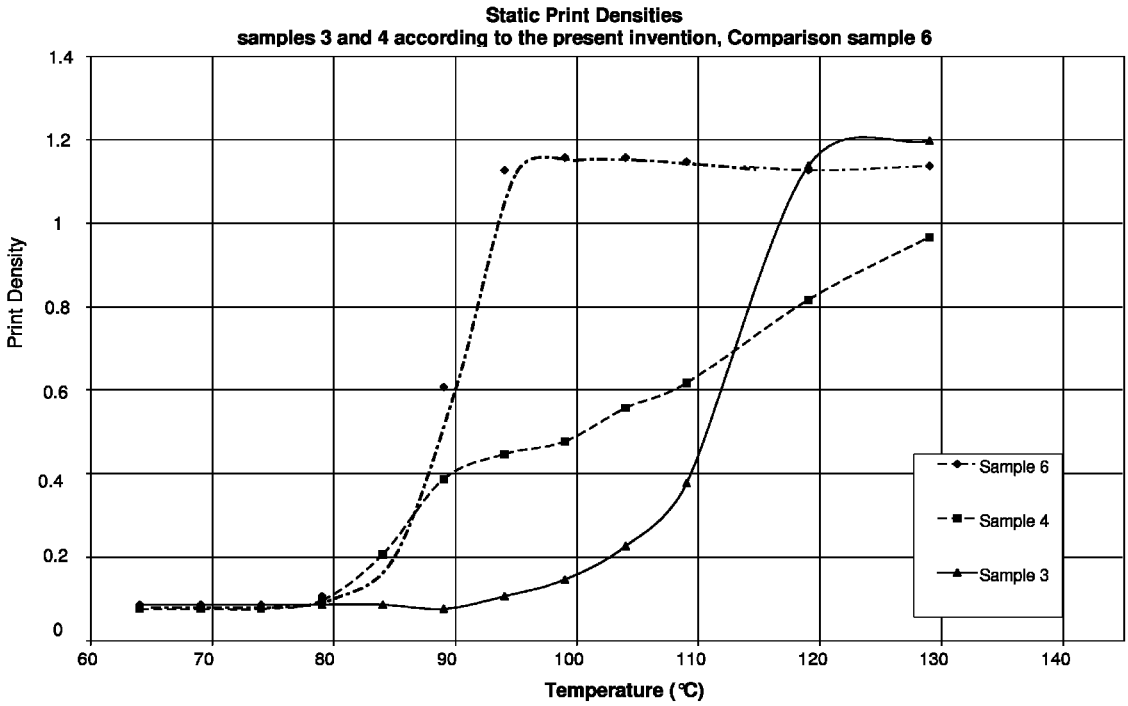
Static Print Densities
samples 3 and 4 according to the present invention, Comparison sample 6
Print Density
Temperature (°C)
1.4
1.2
1
0.8
0.6
0.4
0.2
0
60
70
80
90
100
110
120
130
140
Sample 6
Sample 4
Sample 3

THERMOSENSITIVE RECORDING MATERIAL

BACKGROUND OF THE INVENTION

1. Field of the Invention

The present invention is directed to a heat-sensitive recording material with a substrate on which a heat-sensitive recording layer containing color formers and color acceptors and a protective layer covering this heat-sensitive recording layer are arranged. The present invention is further directed to the use of the proposed heat-sensitive recording material as a ticket and particularly as a parking receipt ticket.

2. Description of the Related Art

Heat-sensitive recording materials have been known for many years and are steadily gaining in popularity. This may be explained by the fact that their use as tickets in particular offers great advantages to ticket suppliers. Because the color-forming components in the heat-sensitive recording process reside in the recording material itself, it is possible to employ large numbers of thermal printers which operate without toner or ink cartridges and whose function need no longer be monitored by persons at regular intervals. Accordingly, this innovative technology has had extensive success particularly in public transportation, busses and rail transportation, air travel, stadium and museum ticket kiosks, and parking receipt dispensers. Yet it is precisely in this very important area of application of parking receipts that numerous problems persist which have not so far been solved in their totality in a convincing manner.

Owing to the fact that parking receipt tickets can be exposed to direct sunlight at very high temperatures when placed behind the windshield, as is frequently required, it happens time and again that the ticket darkens heavily to the point of turning completely black. The print image produced by the thermal printer is then no longer legible, and the tickets become unusable already during their period of validity. Poor resistance of the heat-sensitive recording material used for the parking receipt ticket to grease and plasticizers further impairs the legibility of the printed information. However, parking receipt tickets very often come into contact precisely with these substances because grease often adheres to the fingers and hands of the user, and plasticizers are contained in sleeves into which the parking receipt tickets are inserted during their period of use. This effect is amplified when a paper web having recycled fibers is used as substrate because the recovered papers used for this purpose very often contain contaminants, particularly plasticizers, that can affect the resistance of thermally formed print images.

Another problem is the risk of jamming of ticket rolls after coming into contact with water. For example, when rolls or fan-folded stacks of parking receipt tickets of heat-sensitive recording material to be dispensed are loaded in automatic ticket dispensers in rainy weather, it may happen that these rolls or fan-folded stacks are dampened by raindrops and this moisture penetrates into the ticket rolls or fan-folded stacks. If the constituents particularly in the outer layers of the parking receipt tickets begin to dissolve, the individual layers within a roll or fan-folded stack of parking receipt tickets to be dispensed may stick together resulting in a total breakdown of the automatic ticket dispenser in question. Dust is another problem which arises when heat-sensitive recording material is formed in fan-folded stacks. In particular, heat-sensitive recording material with highly water-resistant protective layers is often very brittle so that the protective layers can flake off at the cut edges and folded edges. This causes dust and disrupts production.

European Patent EP-B-0 899 126 discloses a generic heat-sensitive recording material in which the diacetone-modified polyvinyl alcohol claimed herein as binder in the protective layer is suggested as a characterizing feature. However, an integral component of the known recording material which is indicated as having a good resistance to water, oil and plasticizers is also the use of dicarboxylic acid dihydrazide as an insolubilizer within the recording layer. Although 4,4'-dihydroxydiphenyl sulfone, as one of twenty color acceptors explicitly mentioned, is known from the prior publication along with other groups of alternative color acceptors mentioned for use in the heat-sensitive recording layer, obviousness of a combination of diacetone-modified polyvinyl alcohol as binder in the protective layer with 4,4'-dihydroxydiphenyl sulfone as color acceptor in the heat-sensitive recording layer can be entirely ruled out, especially since the stated objects to be met by the present invention such as improved resistance to heat, folding strength and flexural strength are not mentioned in the prior publication.

A generic heat-sensitive recording material is also disclosed in European Patent Application EP-A-1 900 541. The content of the disclosure of EP-A-1 900 541 does not go beyond the disclosure of the above-cited EP-B-0 899 126.

BRIEF DESCRIPTION OF THE DRAWINGS

FIG. 1 shows the static print densities of the present invention as compared to a comparison sample.

SUMMARY AND DETAILED DESCRIPTION OF THE INVENTION

In order to remedy the problems mentioned in the two preceding paragraphs, it is necessary to provide a heat-sensitive recording material which decisively solves the problem of background darkening and which has a good resistance to oils and plasticizers, but which also withstands flexural tests and folding tests without significant impairment of the usability of the tickets and which, in particular, solves the problem of jamming of ticket rolls after contact with water. To this end, there is provided a heat-sensitive recording material which comprises a substrate, a heat-sensitive recording layer containing color formers and color acceptors, and a protective layer covering this heat-sensitive recording layer, wherein the heat-sensitive recording layer has, as color acceptor, at least 66⅔ percent by weight of 4,4'-dihydroxydiphenyl sulfone based on the total percentage of color acceptors in the heat-sensitive recording layer, and the protective layer has, as binder, at least 60 percent by weight of diacetone-modified polyvinyl alcohol based on the total percentage of binder in the protective layer.

4,4'-Dihydroxydiphenyl sulfone is also commonly called 4,4'-sulfonylbisphenol and is also known under the trade name 4,4 Bisphenol S. The empirical chemical formula of 4,4'-dihydroxydiphenyl sulfone is $C_{12}H_{10}O_4S$, which can be represented by the following formula (1):

Formula 1:

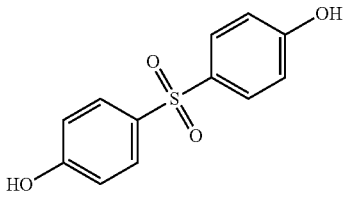

In addition to 4,4'-dihydroxydiphenyl sulfone, the heat-sensitive recording layer of the heat-sensitive recording material according to the invention can have additional color acceptors selected from the list comprising:

2,2-bis(4-hydroxyphenyl)propan—also known as Bisphenol A,

4-[(4-(1-methylethoxy)phenyl)sulfonyl]phenol—also known as D8,

N-(p-toluenesulphonyl)-N'-3-(p-toluenesulphonyloxyphenyl)urea—also known as Pergafast® 201.

In a preferred embodiment, a maximum of 10 percent by weight of the aforementioned color acceptors—based on the total content of color acceptors in the heat-sensitive recording layer—are incorporated individually or in combination in this heat-sensitive recording layer, with 4,4'-dihydroxydiphenyl sulfone accounting for the remainder. Finally, in a particularly preferred embodiment, 4,4'-dihydroxydiphenyl sulfone is the only color acceptor in the heat-sensitive recording layer.

As color formers in the heat-sensitive recording layer, the heat-sensitive recording material preferably has those selected from the list comprising: 3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran, and 3-(N-ethyl-N-tetrahydrofuryl)amino-6-methyl-7-anilinofluoran. 3-dibutylamino-6-methyl-7-anilinofluoran—also known as ODB-2—is particularly preferred.

It is possible for the heat-sensitive recording layer to have more than one color former selected from the color formers listed above. But, in addition to these substances specified as color formers, the recording material according to the invention can also contain one or more of the following compounds which are absorbent in the near infrared range:

3,6-Bis(dimethylamino)fluorene-9-spiro-3'-(6'-dimethylaminophthalide), 3-diethylamino-6-dimethylaminofluorene-9-spiro-3'-(6'-dimethylaminophthalide), 3,6-bis(diethylamino)-fluorene-9-spiro-3'-(6'-dimethylaminophthalide), 3-dibutylamino-6-dimethylaminofluorene-9-spiro-3'-(6'-dimethylaminophthalide), 3-dibutylamino-6-diethylaminofluorene-9-spiro-3'-(6'-dimethylaminophthalide), 3,6-bis(dimethylamino)fluorene-9-spiro-3'-(6'-diethylaminophthalide), 3-diethylamino-6-dimethylaminofluorene-9-spiro-3'-(6'-diethylaminophthalide), 3-dibutylamino-6-dimethylaminofluorene-9-spiro-3'-(6'-diethylaminophthalide), 3,6-bis-(di-ethylamino)fluorene-9-spiro-3'-(6'-diethylaminophthalide), 3,6-bis-(dimethylamino)-fluorene-9-spiro-3'-(6'-dibutylaminophthalide), 3-dibutylamino-6-diethylaminofluorene-9-spiro-3'-(6'-diethylaminophthalide), 3-diethylamino-6-dimethylaminofluorene-9-spiro-3'-(6'-dibutylaminophthalide), 3,3-bis[2-(4-dimethylamino-phenyl)-2-(4-methoxyphenyl)-ethenyl]-4,5,6,7-tetrachlorophthalide.

To increase thermal responsiveness, the recording layer of the heat-sensitive recording material according to the invention can preferably also contain sensitizers, ideally with a melting point of 60° C. to 180° C., particularly preferably with a melting point of 80° C. to 140° C. Examples of sensitizers of this type are: benzyl-p-benzyloxy-benzoate, methylolstearamide, stearic acid amide, p-benzylbiphenyl, 1,2-di(phenoxy)-ethane, 1,2-di(m-methylphenoxy)ethane, m-terphenyl, dibenzyloxalate, benzyl naphthyl ether, dimethyl terephtalate, and diphenyl sulfone, wherein methylolstearamide and, in particular, stearic acid amide and dimethyl terephtalate are especially preferred. It has been shown in numerous tests that a ratio of color acceptor$_{total}$:sensitizer$_{total}$ and particularly 4,4'-dihydroxydiphenyl sulfone:sensitizer selected from the list comprising methylolstearamide, stearic acid amide, and dimethyl terephtalate based on percent by weight in the recording layer is preferably in a range of 1:0.5 to 1:2 and particularly preferably in a range of 1:0.8 to 1:1.4.

Suitable binders for incorporating in the heat-sensitive recording layer are, for example, water-soluble binders such as starch, hydroxy ethyl cellulose, methyl cellulose, carboxy methyl cellulose, gelatins, casein, polyvinyl alcohols, modified polyvinyl alcohols, ethylene vinyl alcohol copolymers, sodium polyacrylates, acrylamide/acrylate copolymers, acrylamide/acrylate/methacrylate terpolymers, and alkali salts of styrene maleic acid anhydride copolymers or ethylene maleic acid anhydride copolymers, wherein the binders can be used alone or in combination with one another; also, water-insoluble latex binders such as styrene-butadiene copolymers, acryl nitrile butadiene copolymers, and methyl acrylate butadiene copolymers can be used as binders for incorporation in the heat-sensitive recording layer. Within the meaning of the present invention, polyvinyl alcohol, ethylene vinyl alcohol copolymers, or polyvinyl alcohol in combination with ethylene vinyl alcohol copolymers are particularly preferred binders and are together incorporated in the heat-sensitive recording layer in a range of 10 to 20 percent by weight based on the total weight of the recording layer.

To prevent sticking to a thermal head and to prevent excessive wear of the thermal head, the coating compound for forming the heat-sensitive recording layer can also contain lubricants and release agents such as metal salts of higher fatty acids, for example, zinc stearate, calcium stearate, and waxes such as, e.g., paraffin, oxidized paraffin, polyethylene, polyethylene oxide, stearic acid amide, and castor wax. Other possible constituents of the recording layer are, for example, pigments, preferably inorganic pigments such as, for example, aluminum (hydr)oxide, silicic acid, and calcium carbonate. Calcium carbonate which is preferably incorporated in the recording layer in a quantity from 0 to 28 percent by weight based on the total weight of the recording layer is preferred.

Roll doctor coating units, knife coating units, curtain coaters, or air brushes can be used in particular as coating devices for applying the heat-sensitive recording layer. According to a preferred embodiment, the coating compound used to form the recording layer is aqueous. The subsequent drying of the coating compound is usually carried out by a process in which heat is supplied such as by hot air floatation dryers or contact dryers. A combination of the aforementioned drying methods has also proven successful. The mass per unit area of the heat-sensitive recording layer is preferably between 2 g/m$^2$ and 6 g/m$^2$ or, better still, between 2.2 g/m$^2$ and 4.8 g/m$^2$.

In a first possible embodiment, the protective layer of the heat-sensitive recording material according to the invention has, in addition to the diacetone-modified polyvinyl alcohol, additional binders, particularly mixtures of different polyvinyl alcohols modified by carboxyl groups or silanol. According to the invention, they account for a maximum of 40 percent by weight, preferably a maximum of 15 percent by weight based on the total percentage of binder in the protective layer. In a second possible embodiment, the protective layer of the heat-sensitive recording material according to the invention has exclusively diacetone-modified polyvinyl alcohol as binder. Particularly when diacetone-modified polyvinyl alcohol is the only binder used in the protective layer covering the heat-sensitive recording layer, it is particularly preferable that the binder proportion in the protective layer is in a range of 35 to 65 percent by weight based on the total weight of the protective layer.

Suitable crosslinking agents in the protective layer are particularly those selected from the group comprising boric acid, polyamine, epoxy resin, dialdehyde, formaldehyde oligomers, epichlorohydrin resin, adipic acid hydrazide, dimethyl urea, and melamine formaldehyde. Mixtures of different crosslinking agents are also possible.

The ratio by weight percent of binder, particularly of the diacetone-modified polyvinyl alcohol, to the crosslinking agent in the protective layer preferably ranges from 20:1 to 5:1, particularly preferably from 12:1 to 7:1.

Particularly good results are achieved when the protective layer additionally contains an inorganic pigment. It is especially recommended that the inorganic pigment is selected from the group comprising silicon dioxide, aluminum hydroxide, bentonite, calcium carbonate, kaolin, or a mixture of these inorganic pigments. A ratio of pigment and kaolin, which is particularly preferred for this purpose, to diacetone-modified polyvinyl alcohol is adjusted within a range of 1:1.5 to 1:4.5 based on the respective weight-percent of pigment and polyvinyl alcohol in the protective layer.

Roll doctor coating units, knife coating units, curtain coaters, or air brushes are particularly suitable as coating devices for applying the protective layer covering the heat-sensitive recording layer. The mass per unit area of the protective layer is preferably between 1.0 $g/m^2$ and 3.0 $g/m^2$ or, better, between 1.6 $g/m^2$ and 2.3 $g/m^2$.

Foils and paper make a suitable substrate for the heat-sensitive recording material proposed herein. For this purpose, coating paper stock with internal sizing is particularly preferable without thereby limiting generality.

In a particularly preferred embodiment, the substrate is a paper web with at least 70 percent by weight of recycled fibers with respect to the total fiber content in the paper web.

In addition to the recycled fiber content of at least 70 percent by weight, the recording material according to the invention in this particularly preferred embodiment can also have fresh pulp, preferably eucalyptus pulp. In a preferred embodiment, the paper web even has a proportion of recycled fibers of at least 85 percent by weight and, further, even 98 percent by weight to 100 percent by weight based on the total fiber content of the paper web.

The proportion of recycled fibers can be made up of one or more different types of recovered paper conforming to the European Standard EN 643 of December 2001. Those types of recovered paper included in Group IV, Higher Grades, as defined by CEPI are particularly suitable in this regard. In particular, these types include: 2.03/2.04—lightly or heavily printed white shavings, mainly wood pulp; 2.05—office papers; 2.07—pulp books; 2.09—carbonless copy paper; 2.10/2.11—PE-coated board; 3.01/3.02/3.04—shavings of printer paper and writing paper, partially woodfree, and pulp-containing tear shavings; 3.05/3.06—white writing papers and business papers; 3.14—white newsprint; 5.06/5.07—printed and unprinted wet-strength pulp papers. However, the invention according to this particularly preferred embodiment is in no way limited exclusively to the above-mentioned types of recovered paper. It is also possible to use the following types of recovered paper for the recycled fibers in the paper web: Group I—mixed grades, and Group III—newsprint and illustrated materials, as defined by CEPI. It becomes especially important in this case that a pigmented intermediate layer is situated between the paper web and the heat-sensitive recording layer at least for visual reasons, although an intermediate layer of this kind would not be considered technically obligatory.

With respect to the recycled fibers used within the framework of the present invention according to this particularly preferred embodiment, a fundamental distinction is made between post-consumer waste paper and higher-grade recovered paper depending on whether the paper was collected before or after being used by the end consumer. Accordingly, higher grades of recovered paper are those that were never used by end consumers but, rather, for example, delivered directly to paper recyclers from publishing houses and/or printers, whereas post-consumer waste paper would be recovered paper which was used at least once by end consumers. Paper webs with recycled fibers having the highest possible proportion of higher-grade recovered paper—quantitatively expressed: a recycled fiber portion comprising at least 70 percent by weight or, preferably, at least 90 percent by weight and particularly preferably 100 percent by weight of higher grades of recovered paper—are especially preferred for the present invention. The percentages (absolutely dry) mentioned above refer to the fiber content of the recycled fibers in the paper web serving as substrate. In practice, a uniform quality and composition of recycled fibers can only be ensured when the proportion of higher-grade recovered paper is especially high. This is very important for guaranteeing print images and resistance, which is increasingly demanded in commercial heat-sensitive recording materials.

In addition to the fiber content, the paper web according to this particularly preferred embodiment also contains a filler. In this respect, a ratio of fiber to filler in percent by weight in a range of 15:1 to 2:1 or, preferred still, 10:1 to 3:1, and particularly preferably 5:1 to 3:1, is considered to be especially suitable. Preferred fillers particularly include calcium carbonate, talc, and kaolin; other possible fillers include aluminum oxide and particularly boehmite, although the invention is not limited to the fillers mentioned above.

The paper web of the heat-sensitive recording material according to the invention preferably has a $Cobb_{60}$ value X, where 15 $g/m^2 < X < 40$ $g/m^2$ or, preferably, a $Cobb_{60}$ value X, where 15 $g/m^2 < X < 35$ $g/m^2$, on the side facing the heat-sensitive recording layer. The minimum $Cobb_{60}$ value is primarily determined by economical considerations and handling limitations with respect to paper webs of this kind. At $Cobb_{60}$ values above 40 $g/m^2$, an excessive penetration of the applied coatings into the paper has been observed, which detracts from the outward appearance of the suggested recording material and, in particular, leads to losses in the dynamic and static print density of the print images to be formed. Excessive penetration of the applied coatings into the paper web also means that greater amounts of coating must be applied, which makes the tickets produced from the proposed recording material too expensive. Trials in which the $Cobb_{60}$ value for the paper web on the side facing the heat-sensitive recording layer was limited to a maximum of 35 $g/m^2$ were particularly compelling with regard to dynamic and static print density.

The $Cobb_{60}$ values mentioned in the specification within the framework of the present invention were determined in conformity with the procedures specified in DIN/EN 20535 and ISO 535 with distilled water at 20° C.

A pigmented intermediate layer is advisably arranged between the heat-sensitive recording layer and the substrate of the heat-sensitive recording material according to the invention. Further, this pigmented intermediate layer is considered preferable regardless of whether the substrate is a foil, coating paper stock, or a paper web with at least 70 percent by weight of recycled fiber according to the particularly preferred embodiment described more fully in the preceding paragraphs.

When the intermediate layer is applied in a preferred embodiment form with leveling coating devices such as, e.g., roll coating units, coating blade units, or (roll) doctor coating units, the intermediate layer can contribute in a positive manner to the leveling of the substrate surface so that the required amount of coating compound to be applied for the heat-sensitive recording layer is reduced. A preferred range of 5 $g/m^2$ to 20 $g/m^2$ or, even better, 7 $g/m^2$ to 12 $g/m^2$ for the mass per unit area of the intermediate layer has proven successful.

When the intermediate layer situated between the recording layer and the substrate contains inorganic, oil-absorbing pigments, these pigments can absorb the wax constituents of the heat-sensitive recording layer which are liquefied by the heating effect of the thermal head during formation of the print and accordingly promote an even more reliable and faster functioning of the heat-induced recording, which is why an embodiment form of this kind is preferred.

It is particularly advantageous when the pigments of the intermediate layer have an oil absorption of at least 80 $cm^3$/100 g or, preferably, 100 $cm^3$/100 g as defined by the Japanese standard JIS K 5101. Calcined kaolin has proven particularly successful by reason of the large absorption reservoir in its voids. However, the following inorganic pigments have also proven to be very well-suited as constituents of the intermediate layer: silicon oxide, bentonite, calcium carbonate, aluminum oxide and, particularly for this purpose, boehmite. Mixtures of a plurality of different inorganic pigments can also be used.

Tests have shown that it can also be very advantageous to incorporate organic pigments in the pigmented intermediate layer. The reason for this is that organic pigments of this kind are highly conducive to a high heat reflectivity of the intermediate layer. The organic, hollow pigments, as they are called, which are arranged in an intermediate layer of a heat-sensitive recording material have air in their interior, which is a good heat insulator. The intermediate layer which is optimized in this way as a heat reflection layer enhances the responsiveness of the recording layer to heat, which appreciably increases the resolution of the heat-sensitive recording layer and particularly the dynamic print density so that the maximum printing speed of the thermal printer in the recording material according to the invention is increased at the same time.

The quantitative ratio of organic to inorganic pigment is a compromise between the effects brought about by the two types of pigment, and one which is met in a particularly advantageous manner when the pigment mixture is composed of 5 to 30 percent by weight or, preferably, 8 to 20 percent by weight of organic pigment to 95 to 70 percent by weight or, more preferably, 92 to 80 percent by weight of inorganic pigment. Pigment mixtures of different organic pigments are also possible.

In addition to the inorganic pigments and possibly organic pigments, the pigmented intermediate layer contains at least one binder, preferably based on a synthetic polymer. For example, styrene-butadiene latex delivers especially good results. The use of a synthetic binder with the addition of at least one natural polymer, preferably starch, represents a particularly suitable embodiment. Further, it was determined in tests with inorganic pigments that a particularly suitable embodiment is achieved with a binder to pigment ratio in the pigmented intermediate layer between 3:7 and 1:9 with respect to percent by weight.

The heat-sensitive recording material proposed herein in all of its preferred embodiments and variants thereof is suitable particularly for use as a parking receipt ticket because fulfilling the requirements imposed on the novel recording material has a particularly positive outcome in this regard.

The mass per unit area in percent by weight (weight-%) indicated in the specification and in the claims refers to absolutely dry weight.

The invention will be further illustrated with reference to the following examples:

To form a first paper web (A) as substrate for a heat-sensitive recording material according to the present invention, a paper pulp comprising fibers with filler and water is placed in a blend chest. One hundred percent of the fibers is made up of higher-grade recovered paper of Group IV, as defined by CEPI, which is not taken from post-consumer waste paper, in particular recovered paper types 2.03/2.04—lightly or heavily printed white shavings, mainly wood pulp; 2.05—office papers; 2.07—pulp books; 2.09—carbonless copy paper; 3.01/3.02/3.04—shavings of printer paper and writing paper, partially woodfree, and pulp-containing tear shavings; 3.05/3.06—white writing papers and business papers. The printing inks in the pulp are separated by a deinking process using the flotation method. The pulp is then reductively bleached by formamidinesulfinic acid (FAS). Finally, additional constituents of the pulp include rosin sizing agent for internal sizing in quantities of 0.6 percent by weight (absolutely dry) based on the total weight of the pulp and, optionally, additional conventional additives such as, e.g., additional pigments and/or optical brighteners. The finished pulp is then fed to a Fourdrinier paper machine in which it is processed to form a paper web with a grammage of 69 $g/m^2$.

After the four paper webs (A) are lightly calendered, a $Cobb_{60}$ value of 18.5 $g/m^2$ is determined on the front side. The ratio of $fiber_{total}$ to pigment in this paper web (A) is 4.98:1.

To form a second paper web (B) as substrate for a heat-sensitive recording material according to the present invention, a paper web of bleached, mechanical hardwood and softwood pulps with a grammage of 58 $g/m^2$ and typical amounts of conventional additives is produced on a Fourdrinier machine. Ground calcium carbonate and talc in a proportion of 8 percent by weight based on the total weight proportion of the paper web (B) are used as filler for the paper web (B).

A pigmented intermediate layer with a mass per unit area of 9 $g/m^2$ is applied to the front side of the two paper webs (A, B) using a roll doctor. The coating compound for forming the intermediate layer has:

- a pigment mixture of hollow pigment and calcined kaolin with a ratio of hollow pigment to calcined kaolin of 1:4 with respect to percent by weight,
- styrene-butadiene latex as binder,
- starch as co-binder
- and additional additives.

A heat-sensitive recording layer with a respective mass per unit area of 4.2 $g/m^2$ is applied to this pigmented intermediate layer in both paper webs (A, B) by a roll doctor coating device as the first coating unit of the coating machine. The aqueous coating compounds used for this purpose contain the following components according to the recipes given in Table 1:

- color former: 3-dibutylamino-6-methyl-7-anilinofluoran, i.e., ODB-2;
- color acceptor 1: 2,2-bis(4-hydroxyphenyl)propan, i.e., BPA;
- color acceptor 2: 4,4'-dihydroxydiphenyl sulfone, i.e., 4,4 BPS;
- sensitizer 1: benzyl naphthyl ether, i.e., BNE;
- sensitizer 2: dimethyl terephtalate, i.e. DMT;
- sensitizer 3: stearic acid amide, i.e., StSA;
- stabilizer: urea-urethane compound according to formula (2), i.e., UU;

Formula (2)

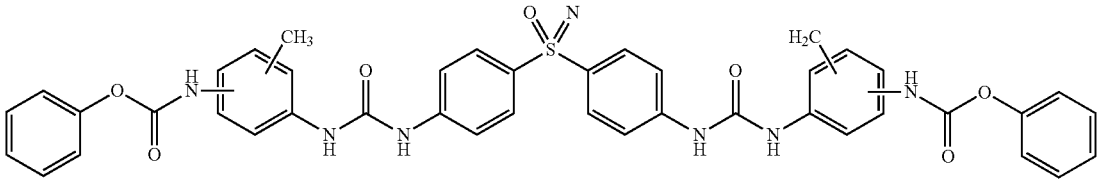

binder 1: ethylene vinyl alcohol copolymer, i.e., EVOH;
binder 2: polyvinyl alcohol, i.e., PVA;
pigment: calcium carbonate, i.e., $CaCO_3$.

TABLE 1

| | Coating compound 1 (according to the invention) | | Coating compound 2 (according to the invention) | | Coating compound 3 (comparison) | |
|---|---|---|---|---|---|---|
| | Component | Weight-% | Component | Weight-% | Component | Weight-% |
| Color former | ODB-2 | 12 | ODB-2 | 10 | ODB-2 | 9 |
| Color acceptor 1 | | | | | BPA | 20 |
| Color acceptor 2 | 4,4 BPS | 27 | 4,4 BPS | 23 | | |
| Stabilizer | | | | | UU | 6.5 |
| Sensitizer 1 | | | | | BNE | 20 |
| Sensitizer 2 | DMT | 34 | | | | |
| Sensitizer 3 | | | StSA | 22 | | |
| Binder 1 | EVOH | 15 | | | EVOH | 16 |
| Binder 2 | | | PVA | 12 | | |
| Pigment | | | $CaCO_3$ | 23 | $CaCO_3$ | 20 |
| Additive | lubricant (zinc stearate) wax cross-linking agent | 12 | lubricant (zinc stearate) wax cross-linking agent | 10 | lubricant (zinc stearate) wax cross-linking agent | 8.5 |

After the heat-sensitive recording layer was dried, a protective layer covering this heat-sensitive recording layer was applied with a mass per unit area of 1.9 g/m$^2$ using an air brush coating device, as second coating unit of the coating machine used, in the same coating machine cycle in which the recording layer was applied. Two aqueous coating compounds according to the recipes in the following Table 2 are used for this purpose.

TABLE 2

| Recipe 1 according to the invention) | | Recipe 2 (comparison) | |
|---|---|---|---|
| Component | Weight-% (absolutely dry) | Component | Weight-% (absolutely dry) |
| diacetone-modified polyvinyl alcohol | 61.3 | acrylate copolymer | 66 |
| pigment: kaolin | 16.6 | pigment: aluminum hydroxide | 12 |
| Hidorin Z-7-30 | 8.1 | Hidorin Z-7-30 | 8 |
| adipic acid hydrazide | 6.0 | polyamidoamine-epichlorohydrin | 5 |
| additives: pH adjuster, optical brightener | 8.0 | additives: pH adjuster, optical brightener | 9 |

The 4 sample webs according to the invention have the following compositions:

❶ Paper web A+pigmented intermediate layer+heat-sensitive recording layer comprising coating compound 1+protective layer according to recipe 1;

❷ Paper web A+pigmented intermediate layer+heat-sensitive recording layer comprising coating compound 2+protective layer according to recipe 1;

❸ Paper web B+pigmented intermediate layer+heat-sensitive recording layer comprising coating compound 1+protective layer according to recipe 1;

❹ Paper web B+pigmented intermediate layer+heat-sensitive recording layer comprising coating compound 2+protective layer according to recipe 1;

Further, there are two comparison sample webs having the following compositions:

❺ Paper web A+pigmented intermediate layer+heat-sensitive recording layer comprising coating compound 3+protective layer according to recipe 2;

❻ Paper web B+pigmented intermediate layer+heat-sensitive recording layer comprising coating compound 3+protective layer according to recipe 2.

The total of six sample webs have been examined with reference to examples cut from the sample webs.

In order to measure the resistance of a thermal test copy in percentage, black-and-white checkered thermal test copies are made from the samples and comparison samples with an Atlantek 400, Printrex (USA). A thermal head with a resolution of 300 dpi and energy per unit surface area of 16 mJ/mm$^2$ was used. For each individual determination of resistance of a thermal test copy in percentage, the print density of the black-colored areas on a thermal test copy is first measured at three locations with a Gretag MacBeth, model D19C NB/U densitometer (Gretag MacBeth, 8105 Regensdorf, Switzerland). The thermal test copy is then treated.

In order to determine resistance to oil in percentage, this treatment consists in immersing the thermal test copy in an oil bath (Mazola corn oil, Unilever Deutschland GmbH, 20457 Hamburg, Germany) at 23° C. oil temperature for 20 minutes. Next, the copy is carefully swabbed off with blotting paper and then left undisturbed for 4 hours at 23° C. and 50% humidity.

To measure resistance to grease in percentage, the treatment consists in heavily coating the thermal test copy with pork lard (Laru Company, Bottrop, Germany). The coated thermal test copy is then left undisturbed for 24 hours at 23° C. and 50% humidity.

After this interval, the print density is again determined at three locations on the black-colored areas with a Gretag MacBeth model D19C NB/U densitometer. The measurements made before and after the treatment, i.e., before and after the oil bath and before and after being treated with grease, respectively, are averaged, and the mean value after the bath is correlated in percentage to the mean value before the bath.

For each individual determination of the resistance, expressed as percentage, of a thermal test copy to plasticizers, a piece of TESA tape (TESA®-Grafik-Film 57331) of approximately 10 cm length is first taped to a thermal test copy prepared by an Atlantek 400, Printrex (USA). The print density of the black-colored areas is then immediately measured at three locations with the Gretag MacBeth model D19C NB/U densitometer. The copy is then left undisturbed for 24 hours at 23° C. and 50% humidity. After this interval, the print density is determined again at three locations of the black-colored areas with the Gretag MacBeth model D19C NB/U densitometer. The respective measurements before and after the idle period during which the treated copy is left undisturbed are averaged, and the mean value after the idle period is correlated with the mean value before the idle period.

The resulting measurements are shown in Table 3:

TABLE 3

| | Sample | | | | | |
|---|---|---|---|---|---|---|
| | ❶ | ❷ | ❸ | ❹ | ❺ | ❻ |
| Resistance to oil (Mazola) | 70% | 72% | 75% | 86% | 41% | 57% |
| Resistance to pork lard | 82% | 82% | 91% | 99% | 67% | 86% |
| Resistance to plasticizers (TESA ®-Grafik-Film 57331) | 69% | 72% | 75% | 86% | 43% | 63% |

The measurements show a clear superiority of the samples according to the invention when directly compared to the comparison samples with respect to the resistance of prepared thermal test copies to oil, grease and plasticizer. The samples according to the invention having a heat-sensitive recording layer of coating compound 2 show even more pronounced resistances than the samples according to the invention having a heat-sensitive recording layer of compound 1. In comparing the measurements, it is important to keep in mind that only measured values with the same paper web (A or B) are compared with one another because the resistance values of examples on paper web (A) are fundamentally worse than examples on paper web (B) owing to the contaminants in the recovered papers.

Aside from the resistance values, analyses of the static print density are also very important because conclusions can be simulated with respect to possible background darkening when parking receipt tickets are placed behind a windshield with direct sunlight and very high temperatures. To this end, examples are prepared from sample webs ❸, ❹ and ❻ with black-and-white checkered thermal print copies by an Atlantek 400 device, Printrex (USA). A thermal head with a resolution of 300 dpi is used with successively triggered temperatures of 60° C., 70° C., 80° C., . . . , 120° C., 130° C., and 140° C. The print densities of the black-colored areas are measured with a Gretag MacBeth, model D19C NB/U densitometer (Gretag MacBeth, 8105 Regensdorf, Switzerland), the print densities are measured at three locations for each measurement value, and the arithmetic mean is calculated from the three individual values. FIG. 1 shows a measurement curve for each sample web ❸, ❹ and ❻.

FIG. 1 shows a clear superiority of samples ❸ and ❹ according to the invention when directly compared to comparison sample ❻ with respect to the static print density. In the present case, it is desirable for the curves to rise as far beyond temperatures above 100° C. as possible. The results shown by sample ❸ according to the invention, which has a heat-sensitive recording layer of coating compound 1, are outstanding because a significant thermal reaction of the recording material according to the invention is first observed beyond 100° C. The results shown by sample ❹ according to the invention, which has a heat-sensitive recording layer with coating compound 2, are still good because in this case, although there is an obvious darkening of the background at 95° C., this background darkening is still so slight that it is still definitely possible to identify a print image induced by a thermal printer. Comparison sample ❻ shows catastrophic results because the background not only darkens, but turns black after 95° C.

In order to determine flaking problems in flexural tests and folding tests, black-and-white checkered thermal test copies are made from sample webs ❶, ❷, ❸, ❹, ❺ and ❻ with an Atlantek 400, Printrex (USA). A thermal head with a resolution of 300 dpi and energy per unit surface area of 16 mJ/mm$^2$ was used. The thermal test copies are folded in half lengthwise in such a way that the left half and right half of the thermal print copy lie on top of one another. Under identical and constant pressing pressure, a laboratory roller is moved along the fold line of the thermal print copy until the thermal print copy is thoroughly folded together along a sharp edge. The thermal print copy is then unfolded and a strip of TESA tape (TESA®-Grafik-Film 57331) is taped to the inner fold line of the thermal print copy and immediately removed again and then taped to a sheet of white paper. The flaked off brittle material then presents a black stripe of varying intensity on the white sheet of paper.

The results shown in the examples of sample webs ❺ and ❻ show a wide, intensely black stripe, which means that the protective layer has flaked off and the underlying recording layer has also been damaged. By contrast, the examples of sample webs ❶, ❷, ❸ and ❹ show hardly any visible black stripes: the protective layer is not chipped, which is a desired achievement of the present invention.

In a test for determining jamming of the heat-sensitive recording material after contact with water, black-and-white checkered thermal test copies are made from sample webs ❶, ❷, ❸, ❹, ❺ and ❻ with an Atlantek 400, Printrex (USA). A thermal head with a resolution of 300 dpi and energy per unit surface area of 16 mJ/mm$^2$ was used. The thermal test copies are immersed for 10 seconds in warm water at 23° C. and then placed on a glass sheet so that the protective layer comes into contact with the glass sheet. The thermal print copies are then allowed to dry for one day at 23° C. and 50% humidity. The thermal print copies are then removed from the glass sheet.

The results of the examples of sample webs ❺ and ❻ show extensive adherence of the thermal print copies to the glass pane; the copies are practically completely destroyed when removed. Sticking of this kind means that jamming of the ticket roll in an automatic parking receipt dispenser is virtually irreversible. On the other hand, the examples of sample webs ❶, ❷, ❸ and ❹ can be removed quite easily from the glass pane. Only isolated sticking occurs, which can be tolerated in view of these very rigorous test parameters.

The test results shown above present convincing proof of the superiority of the heat-sensitive recording materials according to the present invention and, in particular, show that the objects upon which the invention is based have been fully met.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A heat-sensitive recording material comprising a substrate;

a heat-sensitive recording layer containing color formers and color acceptors; and a protective layer containing a binder and covering said heat-sensitive recording layer; and wherein said heat-sensitive recording layer has, as the only color acceptor, at least 66⅔ percent by weight of 4,4'-dihydroxydiphenyl sulfone in said heat-sensitive recording layer, and said protective layer has, as the only binder, at least 60 percent by weight of diacetone-modified polyvinyl alcohol in said protective layer.

2. The heat-sensitive recording material according to claim 1, wherein said color formers of said heat-sensitive recording layer are one or more selected from the list comprising 3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran, and 3-(N-ethyl-N-tetrahydrofuryl)amino-6-methyl-7-anilinofluoran.

3. The heat-sensitive recording material according to claim 1, wherein said heat-sensitive recording layer includes at least one sensitizer selected from the list comprising methylolstearamide, stearic acid amide, and dimethyl terephtalate.

4. The heat-sensitive recording material according to claim 3, wherein the ratio of 4,4'-dihydroxydiphenyl sulfone to sensitizer, selected from the list comprising methylolstearamide, stearic acid amide, and dimethyl terephtalate, is in the range of 1:0.5 to 1:2 based on percent by weight in said recording layer.

5. The heat-sensitive recording material according to claim 1, wherein said the binder in The heat-sensitive recording layer is polyvinyl alcohol, ethylene vinyl alcohol copolymers, or a combination of polyvinyl alcohol and ethylene vinyl alcohol copolymers.

6. The heat-sensitive recording material according to claim 1, wherein said protective layer contains at least one inorganic pigment selected from the group comprising silicon dioxide, aluminum hydroxide, bentonite, calcium carbonate, kaolin.

7. The heat-sensitive recording material according to claim 6, wherein the ratio of inorganic pigment to diacetone-modified polyvinyl alcohol ranges from 1:1.5 to 1:4.5 based on the respective percent by weight of pigment and polyvinyl alcohol in said protective layer.

8. The heat-sensitive recording material according to claim 1, additionally comprising a pigmented intermediate layer formed between said substrate and said heat-sensitive recording layer.

9. The heat-sensitive recording material according to claim 8, wherein said pigmented intermediate layer comprises organic pigments and inorganic pigments, said inorganic pigments being selected from the list comprising calcined kaolin, silicon oxide, bentonite, calcium carbonate, aluminum oxide and boehmite.

10. The heat-sensitive recording material according to claim 1, wherein said substrate is a paper web containing at least 70 percent by weight of recycled fibers based on the total fiber content in said paper web.

11. The heat-sensitive recording material according to claim 10, wherein said paper web has at least 98 percent by weight of recycled fibers based on the total fiber content in said paper web.

12. The heat-sensitive recording material according to claim 10, additionally comprising recycled fibers of higher grade recovered papers and wherein said recycled fibers of said paper web have a proportion of said recycled fibers of higher-grade recovered papers of at least 70 percent by weight.

13. The heat-sensitive recording material according to claim 10, wherein said recycled fibers of said paper web have a proportion of said recycled fibers of higher-grade recovered papers of 100 percent by weight.

* * * * *